US007505034B2

(12) United States Patent
Nguyen

(10) Patent No.: US 7,505,034 B2
(45) Date of Patent: Mar. 17, 2009

(54) METHOD AND APPARATUS FOR REDUCING DISPLAY POWER CONSUMPTION BY CONTROLLING PIXEL COLOR

(75) Inventor: Don J. Nguyen, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 105 days.

(21) Appl. No.: 10/463,286

(22) Filed: Jun. 17, 2003

(65) Prior Publication Data

US 2004/0257316 A1 Dec. 23, 2004

(51) Int. Cl.
*G09G 5/00* (2006.01)

(52) U.S. Cl. ..... 345/211; 345/102; 345/88

(58) Field of Classification Search ..... 345/211–213, 345/102, 690, 82, 87, 88; 713/320, 321, 713/322; 700/21, 22, 79
See application file for complete search history.

(56) References Cited

U.S. PATENT DOCUMENTS 6,335,778 B1 * 1/2002 Kubota et al. ..... 345/98
6,621,482 B2 * 9/2003 Fuller ..... 345/102
6,801,811 B2 * 10/2004 Ranganathan et al. ..... 700/22
6,912,664 B2 * 6/2005 Ranganathan et al. ..... 345/98

OTHER PUBLICATIONS

Product General Specification, LM151X3 Liquid Crystal, LG Philips LCD, Ver. 1.1 Jun. 27, 2000, pp. 1-7.
Engineering Specification, Type 12.1 XGA Color TFT/LCD Module, Model Name: IAXG1M, Document Control No.: OEM I-901M-03, May 28, 2002, pp. 1-29.
Orientdisplay.com, orientdisplay.COM—LCD Provider, http://ww.orientdisplay.com/lcds-basis.html, May 23, 2003, pp. 1-6.
"FAQ—Basis of LCDs", ORIENTDISPLAY.COM, May 23, 2003, pp. 1-6.
"Product General Specification", LG.Philips LCD, LM151X3 Liquid Crystal Display, Ver. 1.1, Jun. 27, 2000, pp. 1-7.
Engineering Specification, "Type 12.1 XGA Color TFT/LCD Module Name: IAXG01M", Doc. Control No.: OEM 1-901M-03, IDTech Engineering Speicfication, May 28, 2002, pp. 1-29.

* cited by examiner

*Primary Examiner*—Kevin M Nguyen
(74) *Attorney, Agent, or Firm*—Blakely, Sokoloff, Taylor & Zafman LLP

(57) ABSTRACT

According to one embodiment, a method of power management for a computer system having a display may include identifying at least one area of interest displayed on a display screen. The area of interest may be a selected window. Color of at least one pixel not associated with the area of interest may be adjusted to a new color that consumes less power than an intended color. This new color may be white when the display is a normally white liquid crystal display (LCD).

22 Claims, 10 Drawing Sheets

METHOD AND APPARATUS FOR REDUCING DISPLAY POWER CONSUMPTION BY CONTROLLING PIXEL COLOR

FIELD OF THE INVENTION

The present invention relates generally to field of power management. More specifically, the present invention relates to methods and apparatuses for controlling power consumption of displays.

BACKGROUND

As more functionality is integrated into modern computer systems, the need to reduce power consumption becomes increasingly important, especially when the computer systems are mobile systems that operate on battery power. Users of mobile systems continuously expect longer battery life.

Mobile system designers try to address the need for longer battery life by implementing power management solutions that include reducing processor and chipset clock speeds, disabling unused components, and reducing power required by displays. Typically, displays used with today's computer systems are liquid crystal displays (LCDs) of transmissive type. Transmissive LCDs require a light source to light the pixels. The light from the light source is sometimes referred to as a backlight as it is located in the back of the LCD. Power consumption of the LCD increases with the brightness of the backlight. In some computer systems, the backlight power consumption may be at approximately 4 Watts and may soar as high as 6 Watts when at its maximum luminance. There are many on-going efforts aimed at reducing the power consumption associated with the display.

BRIEF DESCRIPTION OF THE DRAWINGS

The present invention is illustrated by way of example, and not limitation, in the figures of the accompanying drawings in which like references indicate similar elements and in which.

DETAILED DESCRIPTION

For one embodiment, methods to reduce power consumption of a display in a computer system are disclosed. The reduction of power consumption may be achieved by determining an area of the display that is of interest to a user. Color of pixels associated with other areas may then be controlled such that less power is consumed.

In the following description, for purposes of explanation, numerous specific details are set forth to provide a thorough understanding of the present invention. It will be evident, however, to one skilled in the art that the present invention may be practiced without these specific details. In other instances, well known structures, processes, and devices are shown in block diagram form or are referred to in a summary manner in order to provide an explanation without undue detail.

Computer System

Figure 1:
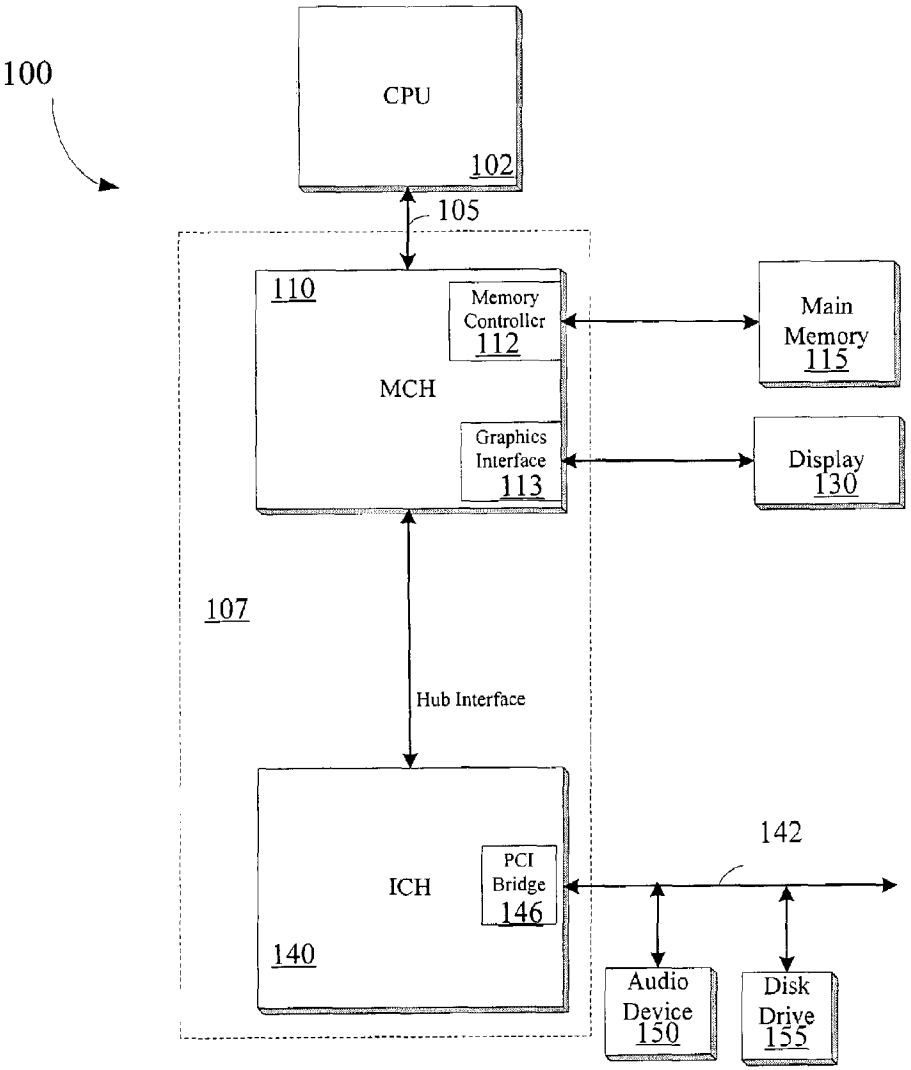
FIG. 1 is a block diagram illustrating an example of a computer system that may be used in accordance with an embodiment of the invention.

FIG. 1 is a block diagram illustrating an example of a computer system that may be used in accordance with an embodiment of the invention. Computer system 100 may include a central processing unit (CPU) 102 and may receive its power from an electrical outlet or a battery. The CPU 102 may be coupled to a bus 105. The CPU 102 may be a processor manufactured by, for example, Intel Corporation of Santa Clara, Calif. Chipset 107 may be coupled to the bus 105. The chipset 107 may include a memory control hub (MCH) 110. The MCH 110 may include a memory controller 112 that is coupled to system memory 115 (e.g., random access memory (RAM), read-only memory (ROM), etc.). The system memory 115 may store data and sequences of instructions that are executed by the CPU 102 or any other processing devices included in the computer system 100.

The MCH 110 may include a graphics interface 113. A display 130 may be coupled to the graphics interface 113. The display 130 may be an LCD. The display 130 may be one implemented using other display technologies. Although not shown, there may be logic to translate a digital representation of an image stored in a storage device such as video memory or system memory into display signals that may be interpreted and displayed by the display 130.

The chipset 107 may also include an input/output control hub (ICH) 140. The ICH 140 is coupled with the MCH 110 via a hub interface. The ICH 140 provides an interface to input/output (I/O) devices within the computer system 100. The ICH 140 may be coupled to a peripheral bus (e.g., Peripheral Component Interconnect (PCI) bus). Thus, the ICH 140 may include a PCI bridge 146 that provides an interface to a PCI bus 142. The PCI bridge 146 may provide a data path between the CPU 102 and peripheral devices. An audio device 150 and a disk drive 155 may be connected to the PCI bus 142. Although not shown, other devices (e.g., keyboard, mouse, etc.) may also be connected to the PCI bus 142.

Liquid Crystal Display (LCD)

Figure 2:
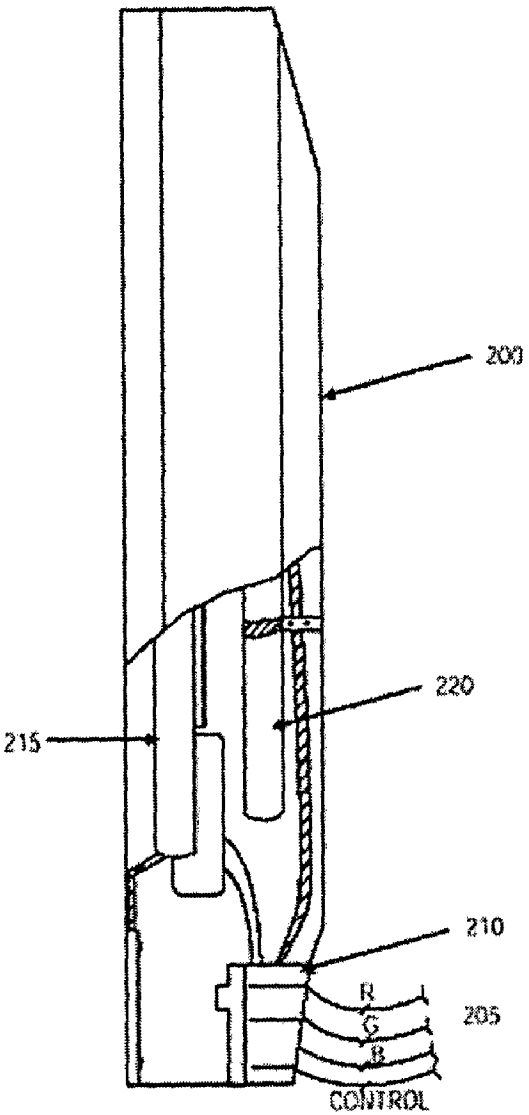
FIG. 2 illustrates an example of a liquid crystal display (LCD).

FIG. 2 illustrates an example of a liquid crystal display (LCD). LCD 200 may be an active-matrix (AM) thin-film-transistor (TFT) LCD. Display control signals 205 generated by logic associated with the graphics interface 113 may be interpreted by control device 210 and may subsequently be displayed by enabling pixels (not shown) on a screen 215. The pixels may be illuminated by backlight 220, the brightness of which may affect the brightness of the pixels and therefore the brightness of the image being displayed. The backlight 220 may be a fluorescent tubes located behind the screen 215 or at the edge along the length of screen 215.

The LCD 200 may offer display quality at different resolution. For example, the LCD 200 may display images at resolution 1024×768 pixels per horizontal and vertical line or lower. Each pixel may be composed of three sub-pixels or dots that, when enabled, cause a red, green, and blue (RGB) color to be displayed, respectively. Each sub-pixel color may vary according to a combination of bits representing each sub-pixel. The number of bits representing a sub-pixel may determine the number of colors, or color depth or grayscales that may be displayed by a sub-pixel. Each sub-pixel may consist of one liquid crystal (LC) and may be accessed by a row and column position. An LC is non-emissive. This means that the LC may need light from a light source such as the backlight 220. An LC is also a capacitor and may respond to alternating voltages. The voltage supplied to the LC may determine the intensity of light that passes through from the backlight 220. LCD technology is known to one skilled in the art.

Figure 3:
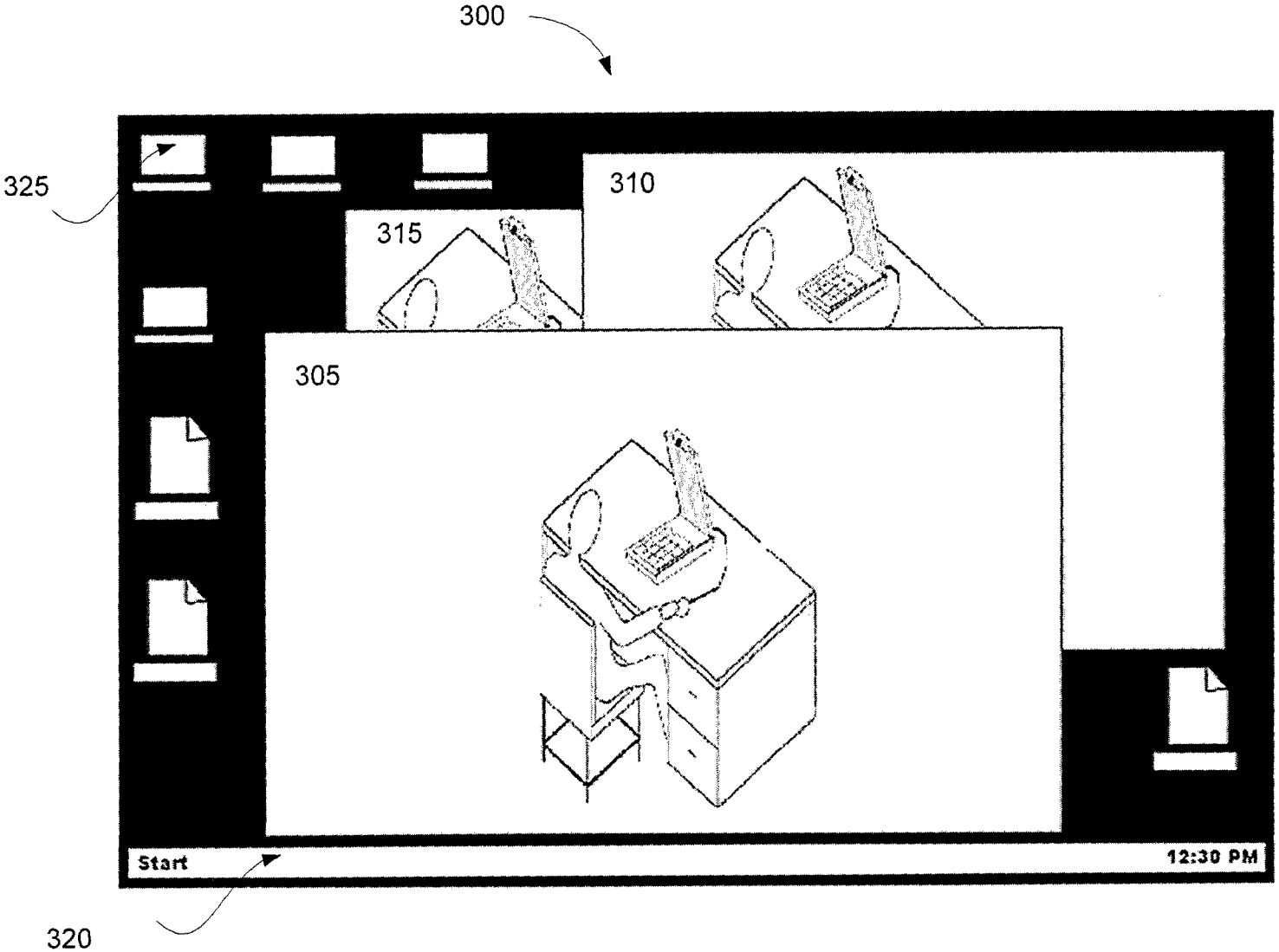
FIG. 3 illustrates an example of images displayed on a LCD.

FIG. 3 illustrates an example of images displayed on a screen of a LCD. Screen 300 may be associated with the LCD 200 illustrated in FIG. 2 and the computer system 100 illustrated in FIG. 1. For one embodiment, the computer system 100 may be configured to operate with a window-based operating system (OS) such as, for example, Microsoft Windows XP developed by Microsoft Corporation of Redmond, Wash. It may be recognized by one skilled in the art that other OS that support displaying information in windows (e.g., Unix, etc.) may also be used. The screen 300 may display a desktop having multiple open windows 305, 310, and 315. The desktop may include icons relating to applications, folders, etc. such as, for example, icon 325. The desktop may also include other information such as, for example, the start bar 320. In this example, the screen 300 may be a normally black screen. This implies that the color of the pixels as seen by a user is black. In a "normally black" screen, power consumption is lower when the information is displayed in black instead of another color such as, for example, white.

Typically, whenever the backlight 220 is on, the light may be distributed uniformly across the screen 300 (and to all of the LCs). The brightness of the backlight 220 may remain the same even though a user of the computer system 100 may not be interested in viewing certain areas of the screen 300. Referring to FIG. 3, even though the windows 305, 310 and 315 are open, the window 305 is at the foreground because it has been selected by a user. Thus, it may be likely that the user may be more interested in the information displayed in the window 305 than information displayed elsewhere. However, because it is not possible to control the backlight 220 to distribute light in different areas of the screen 300, the windows 310 and 315 may be as visible as the window 305, except for the overlapping areas. This may be undesirable because the power required making the windows 310 and 315 visible may be wasted. One technique of reducing the power consumption associated with a LCD such as the LCD 200 includes decreasing the brightness of the backlight 220. However, reducing the brightness of the backlight 220 may affect the quality of the image being displayed. The quality of the image may also suffer when the brightness of the backlight 220 is dimmer than ambient light surrounding the LCD 200.

Figure 4A:
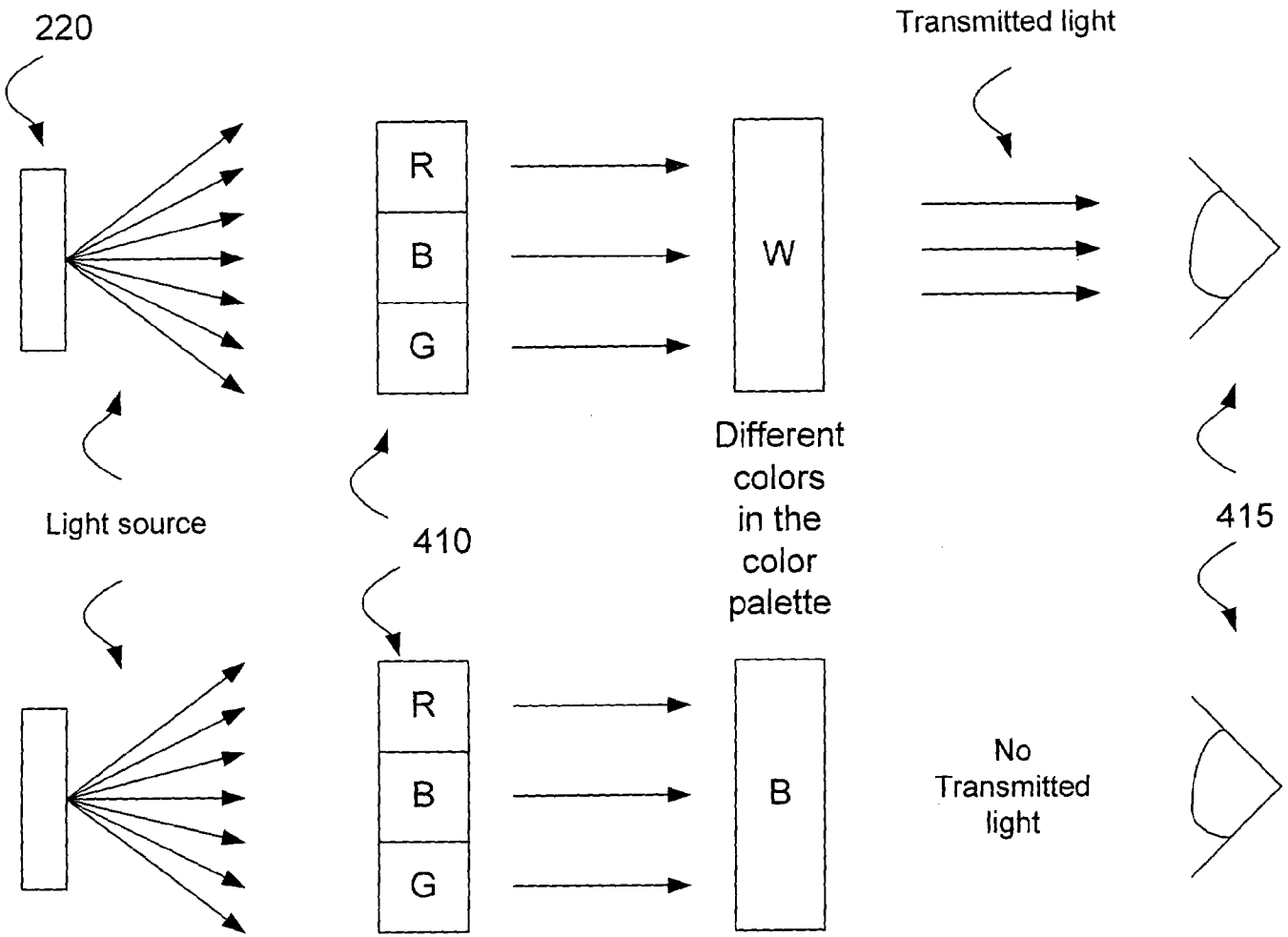
FIG. 4A is a block diagram that illustrates an example of how color of a pixel may be viewed by a user in a normally white display.

FIG. 4A is a block diagram that illustrates an example of how color of a pixel may be viewed by a user in a normally white display. Pixel 410 may include red (R), green (G) and blue (B) sub-pixels. As described above, each sub-pixel may consist of one liquid crystal (LC) which may be a capacitor that can individually respond to variable voltages. The voltage supplied to the LC may determine the gray scale and the intensity of light that passes through from the backlight 220. Depending on the voltage supplied to the LC of each of the sub-pixels, the light that passes through the pixel 410 (also referred to as transmitted light) may be seen by user 415 as white (W), or when no light passes through, and the pixel 410 may be seen by the user 415 as black (B). Of course, depending on the voltage supplied to the LC, the user 415 may also view the pixel 410 in other colors in the color palette. The number of colors in the color palette may depend on the number of bits used to represent each sub-pixel.

The LCD 200 may be a "normally white" LCD. This implies that the color of the pixels as seen by the user 415 is white. The voltage that is supplied to the LC of each of the sub-pixels of the pixel 410 to make the pixel 410 look white (W) may be negligible. To change the color of the pixel 410 from white (W) to black (B) or to any other color may require supplying more voltages to the LCs. This action may dissipate power or require more power from the associated drivers and circuitry that support the LCD 200. For example, with a "normally white" LCD, the voltage needed to get a white pixel is about 2 Vrms, whereas the voltage needed for a black pixel is about 5 Vrms. The situation may be approximately reversed for a "normally black" LCD.

Figure 4B:
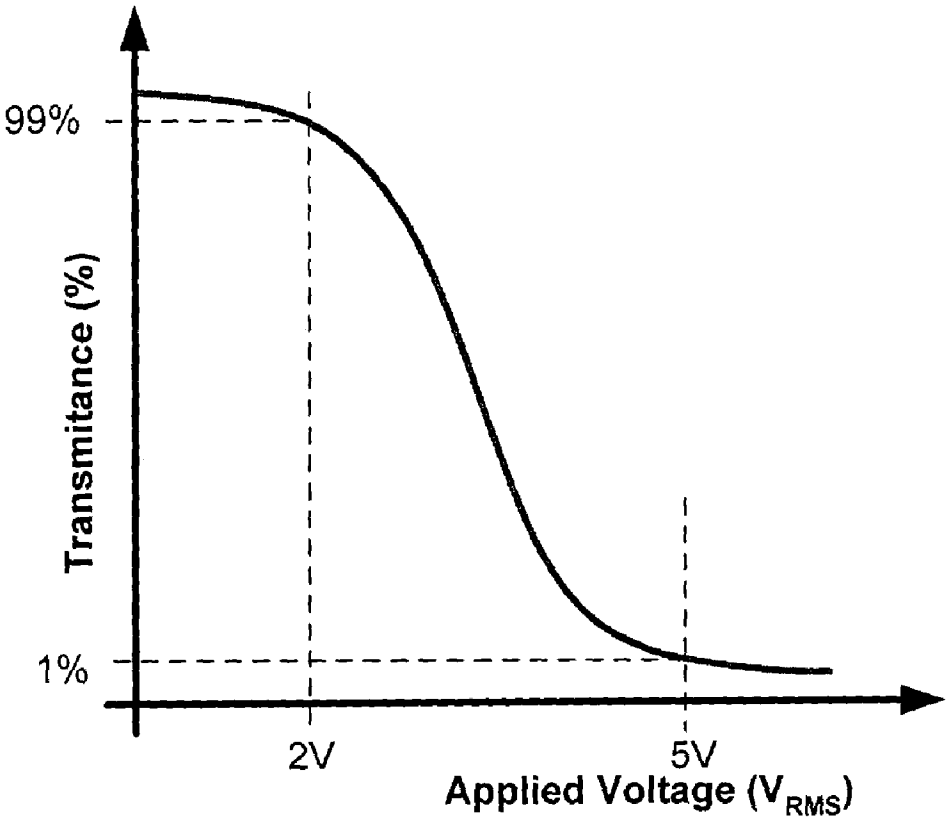
FIG. 4B illustrates an example of a transfer curve describing the transmittance versus driving voltage for liquid crystal materials used in normally-on LCD.

FIG. 4B illustrates an example of a transfer curve describing the transmittance versus driving voltage for liquid crystal materials used in a "normally white" LCD. For illustration purpose, the maximum transmittance (or the amount of transmitted light) may be 99%. The minimum transmittance may be 1%. This minimum transmittance number may be interpreted as 99% of the light source is blocked by the pixel. The ratio between the transmitted light versus the blocked light may be referred to as contrast ratio of a display. For example, a contrast ratio may be about 200:1. This may mean that the 1% transmittance may be much less than 1%. Therefore for a "normally black" LCD, the driving or applied voltage to make pixels look white may be greater than 5 Vrms, which means higher power consumption. Similar high power consumption may be necessary to make pixels in a "normally white" LCD to look black.

LCD used in computer systems today may include many pixels. For example, a display with XGA resolution may contain 1024×768 pixels or 1024×768×3 sub-pixels or dots. The power required to drive a "normally white" LCD from completely white to completely black may be as high as 1 Watt. Similarly, the power required to drive a "normally black" LCD from completely black to completely white may be as high as 1.5 Watts. This level of power consumption may be greater than 10 percents of typical total average platform power consumption.

Figure 5A:
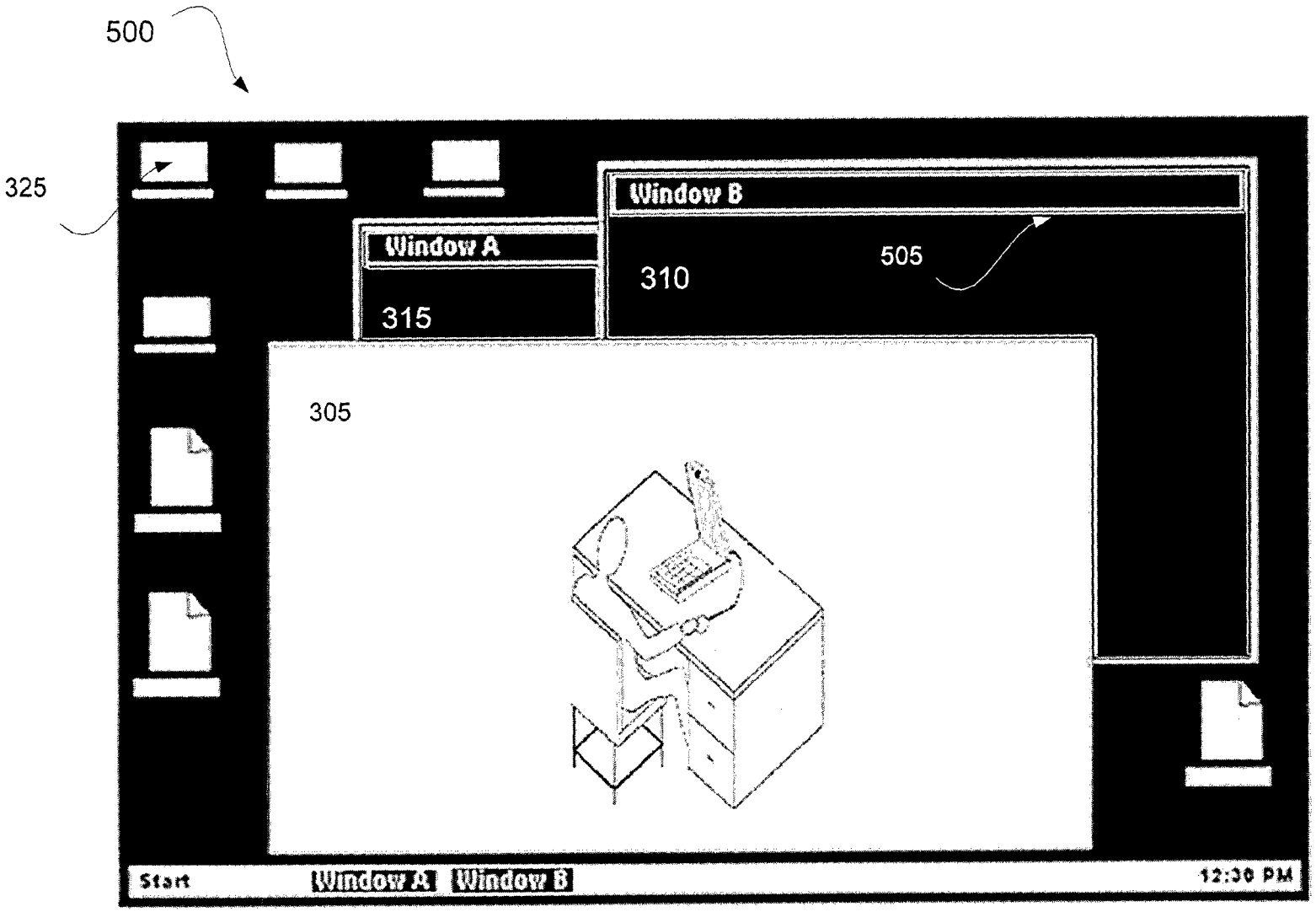
FIG. 5A is an example of a screen of a "normally black" LCD that includes a selected window and one or more non-selected window, according to one embodiment.

FIG. 5A is an example of a screen of a "normally black" LCD that includes a selected window and one or more non-selected window, according to one embodiment. In this example, the screen 500 may include multiple open windows 305, 310 and 315. The screen 500 may be associated with a "normally black" LCD. The window-based OS (e.g., Windows XP, etc.) may keep track of which window is currently selected (e.g., window 305) such that the selected widow may be brought to the foreground. The window-based OS may also keep track of the open windows that are not selected (e.g., windows 310 and 315). For one embodiment, the pixels associated with the non-selected windows may be controlled to look black. For example, referring to FIG. 5A, the areas inside the windows 310 and 315 are illustrated as black. This may be performed by using a color control logic (not shown) to control the voltages supplied to the LC of the sub-pixels. The color control logic may be implemented in software (e.g., a display driver), hardware or a combination of software and hardware. Making portions or all of the pixels associated with the non-selected windows in a "normally black" LCD black may enable some levels of power saving.

Figure 5B:
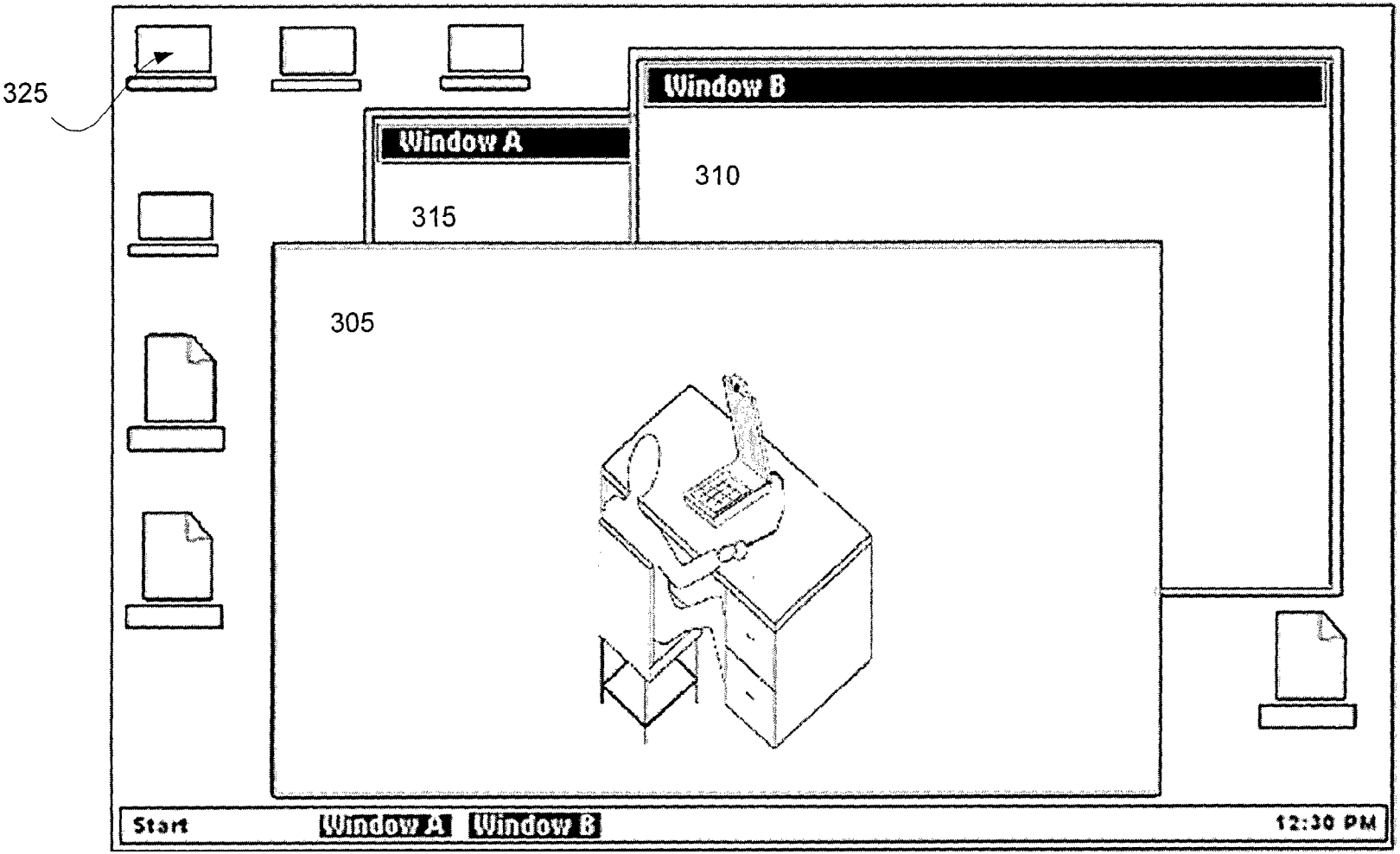
FIG. 5B is an example of a screen of a "normally white" LCD that includes a selected window and one or more non-selected window, according to one embodiment.

For one embodiment, the color control logic may allow certain pixels associated with the non-selected window(s) to be non-black. This may allow these windows to remain somewhat visible for a user to select them when necessary. In the example illustrated in FIG. 5A, the border portions of the non-selected windows 310 and 315 may remain non-black. Portions of the non-selected windows that identify what they are may also remain non-black to the user. This may include, for example, the title bar 505 displayed along the top of the non-selected window 310. FIG. 5B is an example of a screen of a "normally white" LCD that includes a selected window and one or more non-selected window, according to one embodiment.

Figure 6:
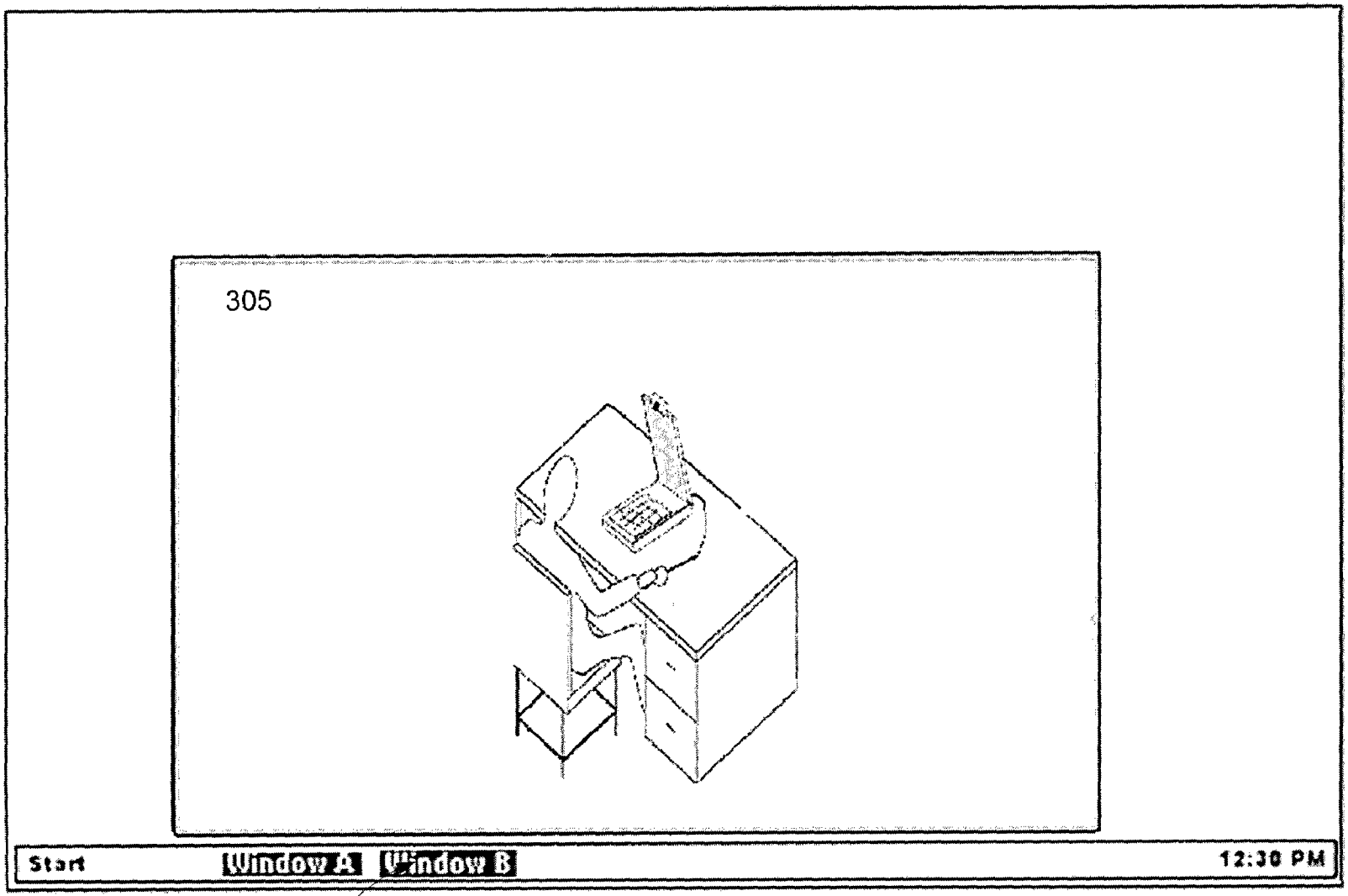
FIG. 6 illustrate examples of making different areas outside of the areas of interest white, according to one embodiment.

For one embodiment, when using a "normally white" LCD, in addition to causing the pixels associated with the non-selected windows to look white, pixels associated with other areas may also be controlled to look white. One example is illustrated in FIG. 6 where only the selected window 305 is visible, and the pixels associated with areas outside of the selected window 305 are controlled to look white. The selected window may be referred to as an area of interest. There may be one or more areas of interest, and the areas of interest may change. The color control logic may need to keep track of when this change occurs so that the appropriate pixels may be controlled to look white. For example, referring to FIG. 6, when the user selects the "Window B" option 605, the color of the pixels associated with the window 315 may go from white to the intended color. Logic may be used to keep track of the intended color.

Figure 7:
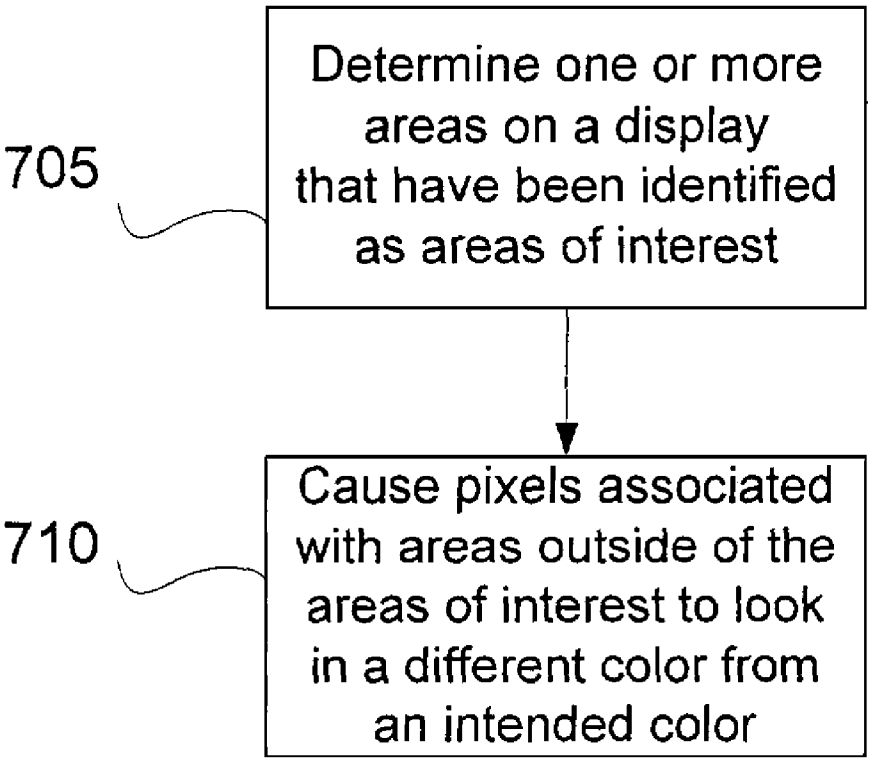
FIG. 7 is a flow diagram illustrating an example of a process performed by the color control logic, according to one embodiment.
Figure 8:
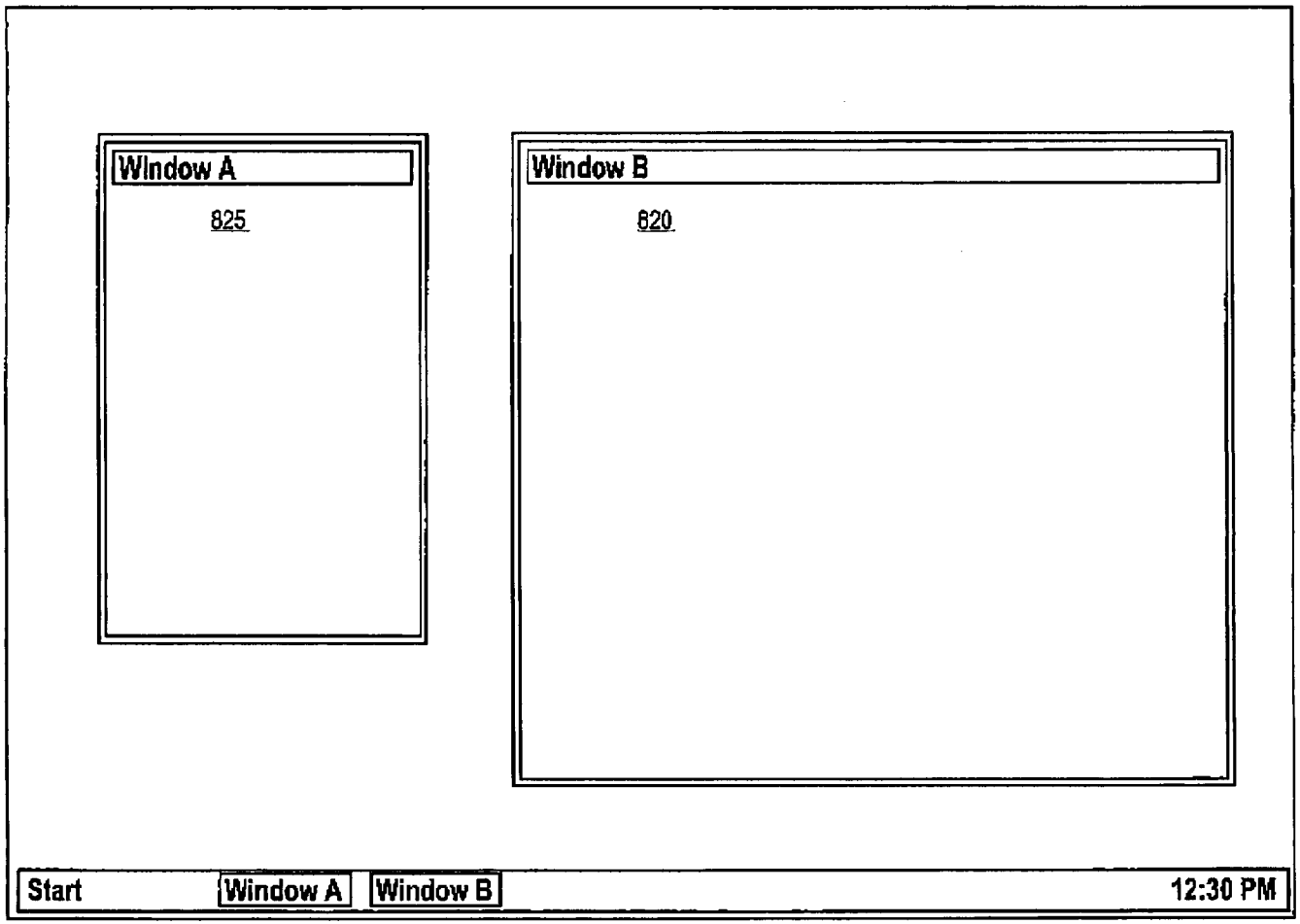
FIG. 8 illustrates an embodiment of a display having multiple open non-overlapping windows.

FIG. 7 is a flow diagram illustrating an example of a process performed by the color control logic, according to one embodiment. The color control logic may be used with a LCD in a computer system configured to operate with a window-based OS. A user using the computer system may open a new window, in which case the new window may be displayed in the foreground. Alternatively, the user may select a window that is already open, in which case the open window is also brought to the foreground. In either situation, a signal may be sent to the OS to indicate that a window is selected.

At block 705, one or more areas on the LCD that have been identified as areas of interest are located. It may be possible that there may be multiple areas of interest. For example, there may be multiple open non-overlapping windows, and the user may specify that these non-overlapping windows include areas of interest. In this example, the color control logic may keep track of non-overlapped windows and may control pixels outside of these windows to look white. For one embodiment, the user may specify an area of interest to be associated with an application regardless of whether the window associated with the application is overlapped or not. In this situation, the color control logic may keep track of this application and not cause the pixels in the window associated with the application to change color.

At block 710, the color control logic may identify pixels not associated with the areas of interest (e.g., pixels of non-selected windows, etc.) and may control these pixels to make them look white when a "normally white" LCD is used. Alternatively, the color control logic may control these pixels to look black when a "normally black" LCD is used. For one embodiment, the color control logic may control those pixels to make them look in a color more visible than white or black, depending on the type of LCD.

Although the techniques described above refer to selected and non-selected windows, one skilled in the art will recognize that the techniques may also be used with other criteria other than or in addition to the selected and non-selected windows to control the color of the pixels. For example, the user may specify a certain display preference and the color control logic may control how the color of the pixels may look based on the user's display preference. Furthermore, although the descriptions refer to the LCD, one skilled in the art will recognize that the techniques may also be applied to other type of display technologies when a backlight may not be utilized. For example, in an organic light-emitting diode (OLED) display, although the backlight is not required, the pixels of the OLED display may be controlled to look in a color that consumed less power consumption when applicable.

The operations of these various techniques may be implemented by a processor in a computer system such as, for example, computer system 100 illustrated in FIG. 1, which executes sequences of computer program instructions that are stored in a memory (e.g., memory 115) which may be considered to be a machine-readable storage media. The memory may be RAM, ROM, persistent storage memory, such as mass storage device or any combination of these devices. Execution of the sequences of instruction may cause the processor to perform operations according to the process described in FIG. 7, for example.

The instructions may be loaded into memory of the computer system from a storage device or from one or more other computer systems (e.g. a server computer system) over a network connection. The instructions may be stored concurrently in several storage devices (e.g. RAM and a hard disk, such as virtual memory). Consequently, the execution of these instructions may be performed directly by the processor. In other cases, the instructions may not be performed directly or they may not be directly executable by the processor. Under these circumstances, the executions may be executed by causing the processor to execute an interpreter that interprets the instructions, or by causing the processor to execute a compiler which converts the received instructions to instructions that which can be directly executed by the processor. In other embodiments, hard-wired circuitry may be used in place of or in combination with software instructions to implement the present invention. Thus, the present invention is not limited to any specific combination of hardware circuitry and software, or to any particular source for the instructions executed by the computer system.

Although the present invention has been described with reference to specific exemplary embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

The invention claimed is:

1. A method for reducing display power consumption, comprising:

identifying a plurality of areas of interest that includes information displayed on a liquid crystal display (LCD) comprising a plurality of pixels, wherein part or all of the pixels not associated with the areas of interest comprise LCD pixels that normally produce a first color, wherein the LCD pixels that normally produce the first color are LCD pixels comprising sub-pixels, wherein minimal voltages supplied to the sub-pixels produce the first color and consume minimal power, and wherein the areas of interest includes areas associated with a plurality of non-overlapping applications identified as applications of interest; and causing at least one pixel on the LCD not associated with the areas of interest to be in a second color close to the first color so as to consume close to the minimum power of the LCD pixels that normally produce the first color, and wherein voltages supplied to sub-pixels associated with pixels in the areas of interest are not changed, and wherein causing the at least one pixel not associated with the areas of interest to be in the second color that consumes less power than an intended color includes adjusting voltages supplied to sub-pixels associated with the pixel.

2. The method of claim 1, further comprising using a backlight to distribute light to the sub-pixels of the plurality of pixels in both areas associated with and not associated with the areas of interest.

3. The method of claim 2, wherein when the at least one LCD pixel not associated with areas of interest is normally black, wherein the first color is approximately black and the voltages supplied to the sub-pixels are adjusted to cause the pixel to look black.

4. The method of claim 2, wherein when the at least one LCD pixel not associated with areas of interest is normally white, wherein the first color is approximately white and the voltages supplied to the sub-pixels are adjusted to cause the at least one pixel to look white.

5. The method of claim 2, wherein the light distributed to the plurality of LCD pixels results in light transmitted through the sub-pixels and in light blocked by the sub-pixels, and obtaining a ratio of the transmitted light verses the blocked light at approximately 200 to 1.

6. The method of claim 1, wherein adjusting the voltages supplied to the sub-pixels includes reducing the voltages supplied to the sub-pixels.

7. A system, comprising:

a processor;

a chipset coupled to the processor, wherein the processor is to operate with a window-based operating system;

a liquid crystal display (LCD) coupled to the chipset, the LCD including pixels associated with a plurality of first areas, wherein the first areas includes a plurality of areas associated with a plurality of non-overlapping selected windows, which are associated with a plurality of applications, and wherein the LCD comprises a plurality of pixels, wherein part or all of the pixels not associated with the first areas comprise LCD pixels that normally produce a first color, wherein the LCD pixels that normally produce the first color are LCD pixels comprising sub-pixels, wherein minimal voltages supplied to the sub-pixels produce the first color and consume minimal power;

a color control logic coupled to the display, wherein the color control logic is to reduce voltages supplied to sub-pixels of at least one pixel not associated with the first areas causing that pixel to have a second color closer to the first color than an intended color so as to consume closer to the minimum power of the LCD pixels that normally produce the first color, wherein causing the at least one pixel not associated with the first areas of interest to be in the second color that consumes less power than the intended color includes adjusting voltages supplied to the sub-pixels associated with the pixel, and wherein voltages supplied by the color control logic to sub-pixels associated with pixels in the areas of interest are not changed; and an input/output control hub coupled to a user interface for providing user preferences to the system to control and/or modify the color control logic while the color control logic is concurrently engaged in reducing voltages supplied to the sub-pixels of the at least one pixel not associated with the area of interest, so as to reduce power consumption of the liquid crystal display.

8. The system of claim 7, wherein the LCD pixel not associated with the first area comprises a normally white LCD which produces the normally first color, wherein the first color is approximately white, causing that pixel to look white when the color control logic reduces the voltages supplied to the sub-pixels of the normally white LCD.

9. The system of claim 7, wherein the LCD pixel not associated with the first area comprises a normally black LCD which produces the normally first color, wherein the first color is approximately black, causing that pixel to look black when the color control logic reduces the voltages supplied to the sub-pixels of the normally black LCD.

10. The system of claim 7, wherein the user preferences provided comprise a selection of an application, wherein windows associated with the application are included in the area of interest.

11. The system of claim 7, wherein light distributed to the plurality of LCD pixels results in light transmitted through the sub-pixels and in light blocked by the sub-pixels, and wherein the LCD pixels provide a ratio of the transmitted light verses the blocked light of approximately 200 to 1.

12. An apparatus, comprising:

a first logic to identify a plurality of first areas displayed on a liquid crystal display (LCD), wherein voltages supplied to sub-pixels associated with pixels in the plurality of areas of interest are not changed;

a second logic to cause at least one LCD pixel comprising a plurality of sub-pixels, having a normally minimum power color, and which is not associated with the first areas, to be viewed in a first color different from an intended color, but closer to the normally minimum power color than the intended color, the first color resulting in lower power consumption than the intended color, wherein the first areas include a plurality of areas associated with a plurality of non-overlapping selected windows, which are associated with a plurality of applications; and an input/output control hub coupled to a user interface for providing user preferences to the apparatus to control and/or modify the second logic while the second logic is concurrently engaged in reducing voltages supplied to the sub-pixels of the at least one pixel not associated with the area of interest, so as to reduce power consumption of the liquid crystal display.

13. The apparatus of claim 12, wherein the second logic causes the at least one pixel not associated with the first area to be viewed in the first color by adjusting voltages supplied to sub-pixels associated with the at least one pixel.

14. The apparatus of claim 13, wherein adjusting the voltages supplied to the sub-pixels includes reducing the voltages applied to the sub-pixels.

15. The apparatus of claim 14, wherein the first color looks white when the normally minimum power color of the LCD is white.

16. The apparatus of claim 14, wherein the first color looks black when the normally minimum power color of the LCD is black.

17. The apparatus of claim 12, wherein light distributed to one or more LCD pixels results in light transmitted through the sub-pixels and in light blocked by the sub-pixels, and wherein the one or more LCD pixels provide a ratio of the transmitted light verses the blocked light of approximately 200 to 1.

18. An article of manufacture, comprising:

a machine readable medium that provides instructions for execution by a machine to perform operations including:

identifying a plurality of areas of interest displayed on a liquid crystal display LCD, wherein voltages supplied to sub-pixels associated with pixels in the areas of interest are not changed;

causing at least one pixel on the LCD not associated with the areas of interest and having a normally first color, wherein minimal voltages supplied to sub-pixels of the at least one pixel produces the first color and consumes minimal power, to be in a second color that is closer to the first color than a color originally intended for that pixel, wherein the second color consumes less power that the originally intended color, and wherein the areas of interest include a plurality of areas associated with a plurality of open non-overlapping windows simultaneously included in the selected areas of interest, which are associated with a plurality of selected applications; and causing an input/output control hub coupled to a user interface to provide user preferences to the machine to control and/or modify the instructions for execution while concurrently engaged in reducing voltages supplied to the sub-pixels of the at least one pixel not associated with the area of interest, so as to reduce power consumption of the LCD.

19. The article of manufacture of claim 18, wherein causing the at least one pixel on the LCD not associated with the area of interest to be in the second color that consumes less power than the intended color includes adjusting voltages supplied to sub-pixels associated with the pixel.

20. The article of manufacture of claim 19, wherein the voltages supplied to the sub-pixels are adjusted to cause the pixel to look white when the normally first color of the LCD is normally white.

21. The article of manufacture of claim 19, wherein the voltages supplied to the sub-pixels are adjusted to cause the pixel to look black when the normally first color of the LCD is normally black.

22. The article of manufacture of claim 18, wherein light distributed to the LCD pixels results in both light transmitted through the sub-pixels and in light blocked by the sub-pixels, and further comprises instructions causing a ratio of the transmitted light verses the blocked light to be approximately 200 to 1.

* * * * *